US006117308A

United States Patent [19]

Ganji

[11] Patent Number: 6,117,308

[45] Date of Patent: Sep. 12, 2000

[54] FOAM REDUCTION IN PETROLEUM COKERS

[76] Inventor: Kazem Ganji, 4008 Nailon Dr., Norman, Okla. 73072

[21] Appl. No.: 09/123,343

[22] Filed: Jul. 28, 1998

[51] Int. Cl.[7] ..... C10G 9/14

[52] U.S. Cl. ..... 208/131; 202/96

[58] Field of Search ..... 208/131; 202/96

[56] References Cited

U.S. PATENT DOCUMENTS

| | | | |
|---|---|---|---|
| 1,729,307 | 9/1929 | Dubbs | 208/131 |
| 2,072,524 | 3/1937 | Mace | 208/75 |
| 2,093,588 | 9/1937 | Forward | 208/106 |
| 2,132,639 | 10/1938 | Morrell | 208/75 |
| 3,917,564 | 11/1975 | Meyers | 208/131 |
| 4,176,052 | 11/1979 | Bruce et al. | 208/131 |
| 4,404,092 | 9/1983 | Audeh et al. | 208/131 |
| 4,443,328 | 4/1984 | Sakurai et al. | 208/106 |
| 4,501,654 | 2/1985 | Allan | 208/92 |
| 4,521,277 | 6/1985 | Calderon et al. | 196/4 |
| 4,612,109 | 9/1986 | Dillon et al. | 208/131 |
| 4,666,585 | 5/1987 | Flagton et al. | 208/131 |
| 4,874,505 | 10/1989 | Bartilinecci et al. | 208/131 |
| 4,919,843 | 4/1990 | Innertsberger et al. | 252/358 |
| 4,961,840 | 10/1990 | Goyal | 208/131 |
| 4,968,407 | 11/1990 | McGrath et al. | 208/131 |
| 4,969,988 | 11/1990 | Jain et al. | 208/108 |
| 4,994,169 | 2/1991 | Godino et al. | 208/50 |
| 5,068,024 | 11/1991 | Moretta et al. | 208/13 |
| 5,169,560 | 12/1992 | Hart | 252/321 |
| 5,296,132 | 3/1994 | Hart | 208/131 |
| 5,389,234 | 2/1995 | Bhargava et al. | 208/131 |
| 5,389,299 | 2/1995 | Hart | 252/321 |
| 5,439,489 | 8/1995 | Scalliet et al. | 44/281 |
| 5,443,717 | 8/1995 | Scalliet et al. | 44/281 |
| 5,667,669 | 9/1997 | Hart | 208/131 |

*Primary Examiner*—Walter D. Griffin
*Assistant Examiner*—Nadine Preisch
*Attorney, Agent, or Firm*—Fellers, Snider, Blankenship, Bailey & Tippens

[57] ABSTRACT

A method and apparatus for at least reducing foam formation and expansion in a coking drum and for preventing foam-overs. In the invention, a fluid is injected into the upper portion of the coking drum during the coking drum fill cycle in a manner effective for at least reducing pressure swings in the coking drum. The fluid is preferably of a type which provides sufficient vapor in the coking drum when added in accordance with the present invention such that the fluid acts to increase the internal pressure of the coking drum and thus counteracts pressure losses which typically occur in the live drum during the fill cycle. In another aspect of the invention, while vapor from the live drum is used to warm an empty drum operating on a different cycle, the pressure of a condensate drum which receives the vapor from the second drum is maintained in a manner effective for reducing pressure losses in the live drum during the warming operation.

15 Claims, 1 Drawing Sheet

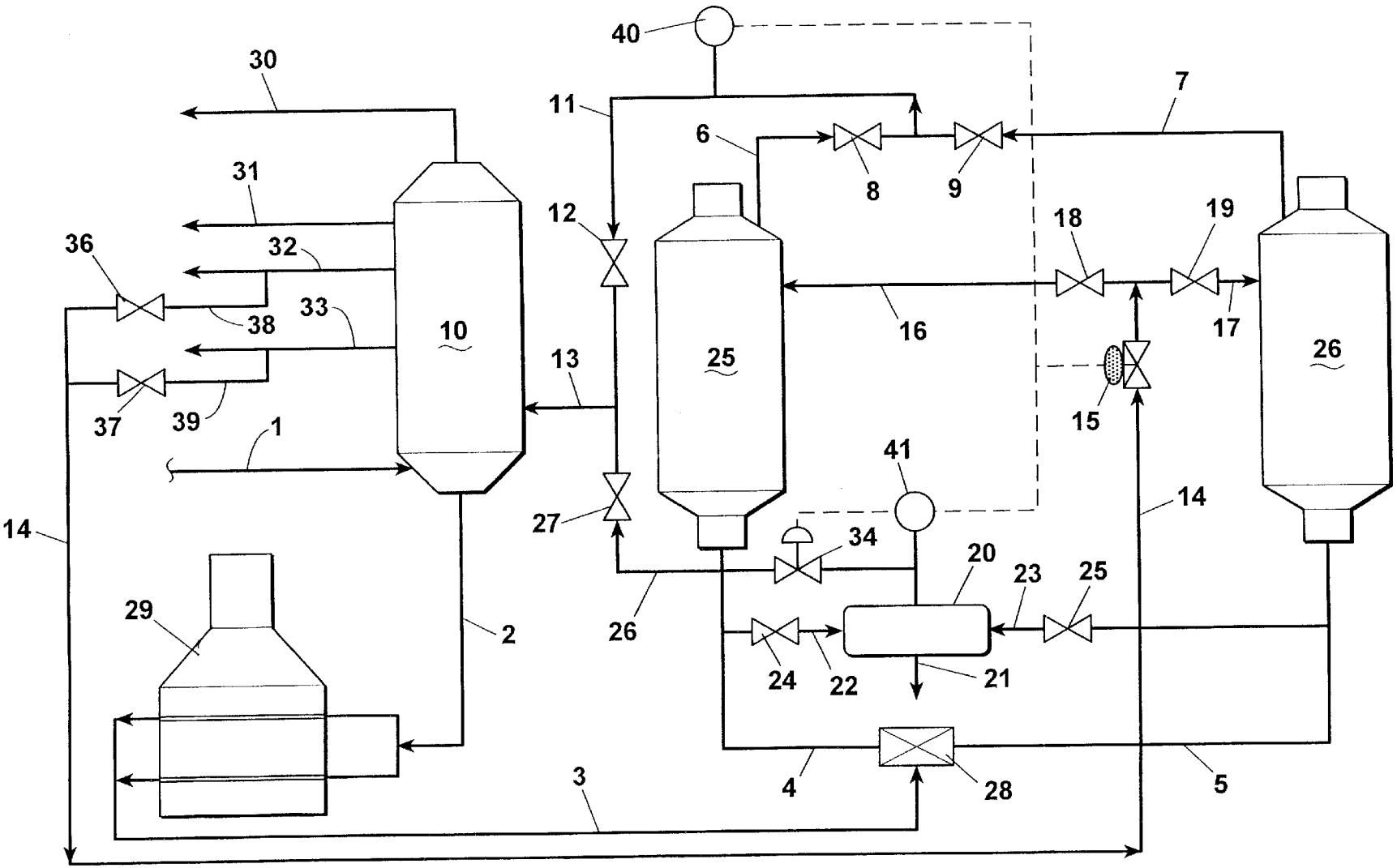
26
17
19
7
14
5
15
18
25
23
9
20
21
28
16
41
8
34
22
4
24
6
25
40
26
11
12
13
27
3
2
10
30
33
32
31
38
1
39
29
36
37
14

FOAM REDUCTION IN PETROLEUM COKERS

FIELD OF THE INVENTION

The present invention relates to methods of and apparatuses for reducing foam formation and expansion, and preventing foamovers, in petroleum coking systems.

BACKGROUND OF THE INVENTION

Coking systems are commonly used in petroleum refineries for converting vacuum tower bottoms and/or other heavy (i.e., high boiling point) residual petroleum materials to petroleum coke and other products. The greater part of each barrel of resid material processed in the coker will typically be recovered as fuel gas, coker gasoline/naphtha, light cycle oil (also commonly referred to by various other names such as light coker gas oil), and heavy cycle oil (also commonly referred to by various other names such as heavy coker gas oil).

A typical delayed coking system comprises: a combination tower or other fractionator; a fired heater; and at least one vertical coking drum. Most coking systems include at least a pair of vertical coking drums. The heavy coker feed is typically delivered to the bottom of the fractionator wherein it is combined with a heavy, liquid, residual bottom product (commonly referred to as a "recycle") produced in the fractionator. The resulting mixture is drawn from the bottom of the fractionator and then pumped through the heater and into at least one coking drum. Typically, multiple coking drums are operated in alternating cycles such that, while one drum (referred to herein as the "live" drum) is operating in a fill cycle, another drum is operating in a second cycle typically comprising a steaming stage, a cooling/quenching stage, a hydraulic decoking stage, a pressure testing stage, and a warmup stage.

In the fill cycle, the hot feed material from the coker heater typically flows into the bottom of the live coking drum. Some of the heavy feed material vaporizes in the heater such that the material entering the bottom of the coking drum is a vapor/liquid mixture. The vapor portion of the mixture undergoes mild cracking in the coking heater and experiences further cracking as it passes upwardly through the coking drum. The hot liquid material undergoes intensive thermal cracking and polymerization in the coking drum such that the liquid material is converted to cracked vapor and petroleum coke. The resulting combined overhead vapor product produced in the coking drum is typically delivered to a lower portion of the fractionator wherein it is separated into gas, naphtha, light cycle oil, and heavy cycle oil, which are withdrawn from the fractionator as products, and a heavy recycle/residual material which flows to the bottom of the fractionator. The light and heavy cycle oil products are typically taken from the fractionator as side-draw products which are further processed (e.g., in a fluid catalytic cracker) to produce gasoline and other desirable end products. The heavy recycle material combines with the heavy feed material in the bottom of the fractionator and, as mentioned above, is pumped with the heavy feed material through the coker heater.

By way of example, but not by way of limitation, typical coker operating conditions and product specifications include: a heater outlet temperature in the range of from about 905 to about 935° F.; coke drum pressures in the range of from about 20 to about 40 psig; live drum overhead temperatures in the range of from about 800° to about 820° F.; a fractionator overhead pressure in the range of from about 10 to about 30 psig; a fractionator bottom temperature in the range of from about 750° to about 780° F.; a light cycle oil draw temperature in the range of from about 450° to about 550° F.; a light cycle oil initial boiling point (ASTM D-1186) in the range of from about 300° to about 325° F.; a light cycle oil end point (D-1186) in the range of from about 600° to about 650° F.; a heavy cycle oil draw temperature in the range of from about 600° to about 690° F.; a heavy cycle oil initial boiling point (D-1186) in the range of from about 470° to about 500° F.; and a heavy cycle oil end point (D-1186) in the range of from about 960° to about 990° F.

One of the most serious and commonly encountered problems in delayed coking operations is foamover. Foamover typically results from the formation of an excessive volume of foam in the live coking drum during the fill cycle. When foamover occurs, partially coked resid is carried into the coke drum overhead line and, depending on the amount of such overflow, can result in: coke lay-down in the coke drum overhead lines; partial plugging of the combination tower bottoms screen; complete plugging of the combination tower bottom screen and a resultant sudden loss of feed to the coker heater; plugged (i.e., coked) heater tubes resulting from the sudden loss of flow therethrough; and plugging of the coker blowdown system. A massive foamover can even carry coke into the upper portions of the combination tower.

Foam is typically formed from condensed and/or entrained liquid hydrocarbons present in the live coking drum during the fill cycle. Condensate can form in the live drum when, for example, hot resid is first switched into the drum at the beginning of the fill cycle. Although the empty drum is typically warmed to a temperature in the range of from about 450° to about 650° F. prior to beginning the fill cycle, the warmed drum is still relatively cool compared to the hot resid material flowing from the coker heater. Thus, some condensation of vapor can occur, particularly on the interior surface of the coking drum.

Condensate can also accumulate in the empty coking drum during the warmup stage. During the warmup stage, a portion of the vapor product from the live coking drum is typically delivered downwardly through the empty drum. For a coking system operating on 20 hour cycles, the warmup stage will typically last for from about three to about four hours. At the beginning of the warmup stage, the temperature of the empty drum will typically be in the range of from about 200 to about 250° F. Thus, a considerable amount of condensed hydrocarbon material can accumulate in the empty coking drum during the warmup operation.

One barrel of condensed and/or entrained hydrocarbon liquid material can form up to 1,200 barrels of foam in the live drum. The foam material travels up the coking drum on top of the coke layer. Several factors promote the formation and expansion of foam material within the filling drum. These include: the amount of condensed and/or entrained liquid hydrocarbon material present in the drum; pressure swings in the live coking drum, particularly significant pressure losses of the type which occur at the beginning of the fill cycle and when diverting vapor product to warm up an empty drum; a significant drop in overhead vapor product temperature; failure of the anti-foam chemical addition system; and over-filling the live drum.

The procedures heretofore used in the art for preventing foamovers have commonly included: attempting to ensure that the unit operators drain completely the warm, empty coking drum before beginning the fill cycle; injecting silicone anti-foam chemicals when a high foam level is detected in the live drum; restricting the fill rate so that the final level of the coke product is significantly below the top of the coking drum; and significantly limiting the amount of warmup vapor taken from the live drum.

The approaches used heretofore for reducing foam formation and expansion have serious shortcomings and are typically highly susceptible to operator error. Restricting fill rates and product levels significantly reduces unit capacity and, by necessitating the use of larger drums and/or a greater number of drums to achieve a given capacity, significantly increases construction costs. Silicone anti-foam chemicals are costly, unreliable, and can significantly poison catalysts used in fluid catalytic crackers and other downstream processing systems.

In addition, attempting to maintain live drum pressure by reducing the amount of warmup vapor taken from the live drum can result in the empty drum being not sufficiently warmed before beginning the fill cycle. Foam formation rates increase rapidly with decreasing switchover temperatures below 600° F. Significantly restricting the rate of warmup vapor flow from the live drum can result in switchover temperatures of as low as 450° F. Low switchover temperatures can produce large pressure and temperature losses at the beginning of the fill cycle.

Due to the fact that the coking drum product vapor constitutes the primary feed to the coking unit fractionator, the fractionator is also adversely affected by pressure, temperature, and product flow fluctuations in the coking drum. Such changes can easily upset the operation of the fractionator and thus have a deleterious effect on the consistency and quality of the product fractions drawn from the fractionator.

SUMMARY OF THE INVENTION

The present invention satisfies the needs and alleviates the problems discussed above. In one aspect, the present invention provides a method of reducing foam formation in a coking drum of a petroleum coking system, the coking drum having an upper pressure and the coking drum being operated in a cyclical manner including a fill cycle in which a heavy petroleum material flows into the coking drum. The method comprises the step of controlling the upper pressure of the coking drum, during at least a portion of the fill cycle, by adding a fluid to the coking drum. The fluid is added in a manner effective for at least reducing pressure swings in the coking drum. When added during the controlling step, the fluid preferably provides a vapor in the coking drum such that the fluid acts in the controlling step to increase the upper pressure of the coking drum.

In another aspect, the present invention provides a method of producing petroleum coke in a petroleum coking system including a first drum and a second drum, the first and second drums being operated in a cyclical manner such that, while the first drum is operating in a fill cycle, wherein a heavy petroleum material flows into the first drum, the second drum is operating in a second cycle including a warmup stage. In the warmup stage, a portion of a vapor product produced in the first drum is delivered through the second drum and into a condensate drum. The method comprises the step of regulating the condensate drum pressure during the warmup stage such that the condensate pressure is not more than 10 psig less than the upper pressure of the first coking drum.

In another aspect, the present invention provides an apparatus for producing petroleum coke comprising: a first coking drum having a first drum pressure; a second coking drum; means for conducting vapor from the first coking drum to the second coking drum for warming the second coking drum; a condensate drum having a condensate drum pressure; means for conducting the vapor from the second coking drum to the condensate drum; and means for controlling the condensate drum pressure with respect to said first drum pressure.

Further aspects, features, and advantages of the present invention will be apparent upon examining the accompanying drawing and upon reading the following description of the preferred embodiments.

BRIEF DESCRIPTION OF THE DRAWING

The FIGURE schematically illustrates a preferred embodiment of the present invention.

DESCRIPTION OF THE PREFERRED EMBODIMENTS

The FIGURE provides a schematic illustration of the present invention as employed in a common type of delayed coking system. Crude vacuum resid and/or other heavy coker feed material flows through conduit 1 to the bottom portion of fractionator 10. In the bottom of fractionator 10, heavy fractionator bottoms liquid (recycle) combines with the coker feed. The resulting heavy liquid material is pumped via conduit 2 through coker heater 29. The hot material then flows through conduit 3 to switch valve 28.

The coking system depicted in the FIGURE includes two vertical coking drums 25 and 26. Drums 25 and 26 are operated on alternating cycles such that, when one drum (i.e., the live drum) is operating in the fill cycle, the other drum is operating in the de-coking and preparation cycle. The de-coking and preparation cycle typically includes a sequence of operations including: a steaming stage; a cooling/quenching stage; a hydraulic de-coking stage; a pressure testing stage; and a warmup stage. If drum 25 is operating in the fill cycle, valve 24 is closed and switch valve 28 diverts the hot feed material to the bottom of drum 25 via conduit 4. However, if drum 26 is operating in the fill cycle, valve 25 is closed and switch valve 28 diverts the hot feed material to the bottom of drum 26 via conduit 5. Assuming that drum 25 is operating in the fill cycle, drum 26 overhead valve 9 will be closed and drum 25 overhead valve 8 will be open such that the vapor produced in live drum 25 will flow to fractionator 10 via lines 6, 11, and 13.

Although a plurality of coking drums 25 and 26 are shown in the FIGURE, it will be understood that the inventive injection method described herein can also be employed in coking systems having only one coking drum.

Fractionator 10 will preferably include typical pump-around and condensing systems (not shown) for fractionating the vapor product. Typical products provided by the fractionator will include: an overhead cracked gas (e.g., fuel gas) product 30; an overhead gasoline/naphtha distillate product 31; a light cycle oil side draw product 32; and a heavy gas oil side draw product 33. As indicated above, various names are used in the art to identify the light and heavy cycle oil products. The names "light cycle oil" and "heavy cycle oil" used herein and in the claims refer to and encompass all such products.

When drum 26 reaches the warmup stage of the second operating cycle, overhead valve 9 is opened such that a portion of the vapor product produced in live drum 25 flows into the top of drum 26 via line 7. Valves 25 and 27 are also opened such that the warmup vapor flows downward through drum 26 and then into condensate drum 20 via line 23. Condensate produced in the warmup process collects in condensate drum 20 and is removed via conduit 21. The non-condensed warmup material flows from condensate drum 20 to vapor product line 13 via line 26. The non-condensed warmup material then flows with the remaining overhead product vapor into fractionator 10.

As will be understood by those skilled in the art, the operating conditions employed in the coking system can vary substantially depending upon: the specific coker feed used; desired product specifications; desired product make; unit design; etc. Generally any desired conditions and parameters can be used when employing the present invention.

For purposes of illustration, and without in any way limiting the scope of the present invention, one common set of operating parameters, and the results obtained without benefit of the present invention, might include: a live drum bottom temperature of about 900° F.; a live drum overhead temperature varying during the fill cycle between about 800° and about 820° F.; a live drum overhead pressure varying between about 23 and about 34 psig; and a cold drum (pre-warmup) temperature of from about 200 to about 250° F. For the first three to four hours after switching to the fill cycle, the live drum pressure will typically drop by an amount in the range of from about 5 to about 10 psig. The pressure also typically fluctuates substantially during the latter half of the fill cycle, particularly during the period in which vapor from the live drum is used to warm up an empty drum. During the warmup stage, the live drum upper/overhead pressure will typically drop by an amount in the range of from about 3 to 5 psig and the temperature of the overhead vapor will typically drop by an amount in the range of from about 10 to about 20° F.

Pressure losses in the live drum, particularly during the initial and warmup stages of the fill cycle, result in a higher vapor velocity within the drum and thus cause a substantial increase in foam production and expansion. Significant temperature losses typically occurring during these periods further contribute to foam production and expansion. By the end of the fill cycle, the formation of a foam front of up to 30 feet and more above the coke layer is not unusual.

In the present invention, a fluid is added to the live coking drum in a manner and in an amount effective for reducing pressure swings within the live coking drum. The fluid is preferably injected into the upper portion of the coking drum through the side wall or through the upper head of the drum. As employed in the present invention, the injected fluid preferably increases the amount of vapor formed in the live drum and thus operates to increase the pressure within the live drum and thereby compensate for pressure losses. Most preferably, the fluid is added in a manner and amount effective for maintaining a substantially constant pressure in the live drum.

Although preferably employed throughout the fill cycle, the present invention can be selectively employed in the live drum during (a) the initial stage of the fill cycle (preferably during at least the first three to four hours of the fill cycle), (b) the empty drum warmup stage of the fill cycle, (c) the latter half of the fill cycle, and/or (d) any other portion of the fill cycle. When initiated in a latter portion of the fill cycle, the present invention also operates to significantly collapse the foam front formed during the previous portion of the cycle.

Examples of suitable injection materials include: steam; water; hydrocarbon liquids which will either completely vaporize in the live drum or will vaporize at least to an extent sufficient to add pressure to the coking drum; and hydrocarbon vapor. The fluid is preferably a coker fractionator side draw or overhead product. The fluid is more preferably light cycle oil, heavy cycle oil, or a combination thereof. The fluid is most preferably heavy cycle oil. In most commercial coking units, a light cycle oil and/or heavy cycle oil injection rate of from about 40 to about 70 gallons per minute will be sufficient to maintain a substantially constant, or at least much stabiler, overhead pressure in the coking drum throughout the fill cycle.

Coker products are simply re-recovered in the coker fractionator and are therefore particularly well suited for use in accordance with the present invention. Heavier coker product fractions are less volatile than lighter fractions and therefore provide a more stable pressure control medium. Heavier fractions can also be delivered to the coking drum at higher temperatures such that, at typical injection rates, they will not significantly decrease the coking drum overhead temperature. Maintaining a higher coking drum overhead temperature reduces foam production and expansion and facilitates the attainment of higher warmup temperatures.

Depending upon whether the light and/or heavy cycle oil material is obtained (a) directly from the fractionator, (b) after stripping, or (c) after cooling/heat exchange, the material will typically be injected into the live drum at a temperature in the range of from about 150° to about 690° F., preferably from about 450° to about 690° F. Most preferably, heavy cycle oil will be injected into the live drum at a temperature in the range of from about 600° to about 690° F.

In the embodiment of the present invention depicted in the FIGURE, valves 36 and 37 can be opened or closed as desired to deliver a light cycle oil and/or heavy cycle oil slip stream to coker drums 25 and 26. Valves 18 and 19, provided in lines 16 and 17, respectively, can be opened and closed as necessary to direct the injection material to the particular drum 25 or 26 operating in the fill cycle. The light and/or heavy cycle oil injection material is delivered to lines 16 and 17 via conduits 36 and/or 37 and conduit 14. A valve 15 is provided in conduit 14 for controlling the rate at which the material is injected into the live drum 25 or 26. Valve 15 can be operated manually to maintain a substantially constant, or at least more stable, pressure within the live drum. Most preferably, a pressure controller 40 is provided for automatically controlling valve 15 based on the live drum pressure such that valve 15 opens as the pressure in drum 40 decreases. As indicated in the FIGURE, the live drum pressure will typically be measured in coke drum overhead line 11.

The inventive system stabilizes the coking drum pressure and thus minimizes foam production and expansion in the live drum. With stable pressure conditions, vapor velocity within the live drum will be substantially constant. The inventive system also operates to provide additional hot vapor material for warming the empty drum. Thus, warmup temperatures of 600+° F. can be consistently achieved. Moreover, the desired warmup temperature is achieved in a shorter period of time. Further, the present invention reduces anti-foam chemical usage by at least about 75%.

When using the present invention, the foam front formed in the live drum will typically be only about 1 to about 5 feet deep. Thus, by eliminating up to 25+ feet of foam, the present invention also substantially increases the available capacity of the coking system.

In another aspect of the present invention, a valve 34 is provided in condensate drum overhead line 26 for regulating the pressure of condensate drum 20. Condensate drum 20 is maintained at a pressure effective for reducing pressure losses in the live coking drum when warming up an empty drum. The pressure in condensate drum 20 is preferably maintained at not more than 10 psig less than the overhead pressure of the live coking drum. Condensate drum 20 is most preferably maintained at a pressure in the range of from about 5 to 10 psig less than the overhead pressure of the live coking drum.

Valve 34 can be manually operated for regulating the pressure in condensate drum 20. Most preferably, a controller 41 is provided for automatically operating valve 34 in conjunction with the coke drum overhead pressure signal provided by controller 40. As will be understood by those skilled in the art, controllers 40 and 41 can be electronic, pneumatic, or of any other type commonly employed in the industry.

Controlling the pressure of condensate drum 20 in the manner provided by the present invention operates to decrease foam formation and expansion in the coking drums by preventing significant depressurization of the live drum during the warmup operation and by providing a significantly higher empty drum pressure at the beginning of the fill cycle.

EXAMPLE

A delayed coking system having two, each of about 27 feet in diameter, coking drums on 20 hour cycles was operated with a vacuum resid feed material at a feed flow rate of 32,000 barrels per day and a heater outlet temperature of from about 915 to 920° F. Outage detectors were provided in each drum at levels of 10 feet from the top of the drum, 20 feet from the top of the drum, and 30 feet from the top of the drum. Operating without benefit of the present invention, the pressure in the live drum at the beginning of the live cycle was 34 psig but quickly dropped to 26 psig. The original pressure of 34 psig pressure was not regained in the live drum until five hours into the fill cycle. The pressure then began to decrease again such that the live drum overhead pressure was 29 psig at 10 hours into the fill cycle and was only 25 psig at the end of the 20 hour fill cycle. The empty drum warmup stage was begun at 16 hours and continued throughout substantially the remainder of the 20 hour cycle.

At 10 hours into the fill cycle, foam was detected at the 30 foot outage point. Coke product was then detected at the 30 foot outage point at 11 hours into the fill cycle. At 12 hours into the fill cycle, foam was detected at the 20 foot outage point and coke was then detected at the 20 foot outage point at 13 hours. Finally, foam was detected at the 10 foot outage point at 19 hours into the fill cycle. Based on these results, the estimated final depth of the foam front in the live drum was about 30 feet.

This test was repeated using the inventive method. Heavy coker cycle oil was injected into the top of the live coking drum, as necessary, throughout the fill cycle to maintain the overhead pressure of the live drum at 34 psig. During this process, the heavy coker cycle oil was controlled at a rate in the range of from about 40 to about 70 gallons per minute.

In this test of the inventive method, foam was never detected at the 10 foot outage level. Foam was first detected at the 30 foot outage level at 17 hours into the cycle and was not detected at the 20 foot outage level until 19 hours into the fill cycle. Coke was detected at the 30 foot outage level at 18 hours into the cycle. Based on these results, the final depth of the foam front formed in the live drum was calculated to be only approximately 3 to 5 feet.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A method of reducing foam formation in a coking drum of a petroleum coking system, said petroleum coking system receiving a coker feed material, said coking drum having an upper pressure and said coking drum being operated in a cyclical manner including (a) a fill cycle wherein at least a portion of said coker feed material flows into said coking drum to form a layer of coke, and (b) a second cycle wherein said portion of said coker feed material does not flow into said coking drum and during at least a portion of which said coke is removed from said coking drum, said method comprising the step of controlling said upper pressure, during at least a portion of said fill cycle, by adding a fluid to said coking drum of a type and in a manner effective for at least reducing pressure swings in said coking drum, wherein said fluid is a material other than said coker feed material.

2. The method of claim 1 wherein said fluid provides a vapor in said coking drum when added during said step of controlling such that said fluid acts in said controlling step to increase said upper pressure.

3. The method of claim 1 wherein:

said petroleum coking system further includes a fractionator for fractionating a vapor; product produced in said coking drum;

said fractionator produces cycle oil, a recycle material, and at least one light product having an end point temperature below that of said cycle oil; and said fluid comprises at least a portion of said light product, at least a portion of said cycle oil, or a combination thereof.

4. The method of claim 3 wherein said cycle oil comprises a light coker cycle oil product and a heavy coker cycle oil product and wherein said fluid comprises at least a portion of said light coker cycle oil product, at least a portion of said heavy coker cycle oil product, or a combination thereof.

5. The method of claim 3 wherein said fluid is at least a portion of said heavy coker cycle oil product.

6. The method of claim 1 wherein, in said fill cycle, said portion of said coker feed flows into a lower end portion of said coking drum and, in said step of controlling, said fluid is delivered into an upper end portion of said coking drum.

7. The method of claim 1 wherein: said coking drum is a first coking drum; said coking system further includes a second coking drum operated with said first drum in said cyclical manner such that, when said first coking drum is operating in said fill cycle, said second drum operates in said second cycle, said second cycle including a warmup stage wherein said second coking drum is substantially empty and a portion of a vapor product produced in said first drum is directed through said second coking drum; and, while said second drum is in said warmup stage, said step of controlling is employed in said first drum to prevent said upper pressure of said first drum from decreasing substantially.

8. The method of claim 7 wherein:

said coking system further includes a condensate drum having a condensate drum pressure;

said portion of said vapor product flows during said warmup stage from said second coking drum to said condensate drum; and said method further comprises the step of regulating said condensate drum pressure during said warmup stage of said second drum in a manner effective for at least reducing pressure swings in said first coking drum.

9. The method of claim 1 wherein, during said step of controlling, said fluid is added to said coking drum at a rate which is automatically regulated based upon said upper pressure.

10. The method of claim 3 wherein:

in said fill cycle, said recycle material and said portion of said coker feed are delivered into a lower end portion of said coking drum and, in said step of controlling, said fluid is delivered into an upper end portion of said coking drum.

11. The method of claim 3 wherein said fluid is said portion of said cycle oil.

12. The method of claim 11 wherein said fluid is delivered, without substantial heating, from said fractionator to said coking drum.

13. The method of claim 12 wherein said fluid is delivered to said coking drum at a temperature in the range of from about 450° to about 690° F.

14. The method of claim 13 wherein said fluid has a D-1186 end point of not more than 990° F.

15. The method of claim 8 wherein, in said warmup stage, said portion of said vapor product flows downwardly through said second coking drum.

* * * * *

UNITED STATES PATENT AND TRADEMARK OFFICE
CERTIFICATE OF CORRECTION

PATENT NO : 6,117,308

DATED : September 12, 2000

INVENTOR(S) : KAZEM GANJI

It is certified that error appears in the above-identified patent and that said Letters Patent are hereby corrected as shown below:

Col. 8, line 34
replace "ator for fractionating a vapor; product produced in said"
with --ator for fractionating a vapor product produced in said--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*